US010181263B2

(12) United States Patent
Xu et al.

(10) Patent No.: US 10,181,263 B2
(45) Date of Patent: Jan. 15, 2019

(54) METHOD, APPARATUS AND COMPUTER PROGRAM PRODUCT FOR ESTIMATION OF ROAD TRAFFIC CONDITION USING TRAFFIC SIGNAL DATA

(71) Applicant: HERE Global B.V., Eindhoven (NL)

(72) Inventors: Jingwei Xu, Chicago, IL (US); Xin Gao, Chicago, IL (US); Weimin Huang, Chicago, IL (US); Bruce Bernhardt, Chicago, IL (US)

(73) Assignee: HERE Global B.V., Eindhoven (NL)

( * ) Notice: Subject to any disclaimer, the term of this patent is extended or adjusted under 35 U.S.C. 154(b) by 35 days.

(21) Appl. No.: 15/363,711

(22) Filed: Nov. 29, 2016

(65) Prior Publication Data

US 2018/0151064 A1 May 31, 2018

(51) Int. Cl.
*G08G 1/01* (2006.01)

(52) U.S. Cl.
CPC ..... *G08G 1/0125* (2013.01); *G08G 1/0112* (2013.01); *G08G 1/0116* (2013.01); *G08G 1/0133* (2013.01); *G08G 1/0141* (2013.01); *G08G 1/0145* (2013.01)

(58) Field of Classification Search
None
See application file for complete search history.

(56) References Cited

U.S. PATENT DOCUMENTS

2002/0026277 A1 2/2002 Kerner et al.
2002/0077742 A1 6/2002 Mintz
2002/0116118 A1* 8/2002 Stallard ..... G08G 1/01 701/117
2003/0063015 A1* 4/2003 Ebner ..... G08G 1/081 340/907
2004/0130463 A1* 7/2004 Bloomquist ..... G08G 1/096716 340/907

(Continued)

FOREIGN PATENT DOCUMENTS

AU 2009243492 A1 7/2010
CN 1707544 A 12/2005

(Continued)

OTHER PUBLICATIONS

English Translation of CN102436751B Abstract.*

(Continued)

*Primary Examiner* — Rami Khatib
(74) *Attorney, Agent, or Firm* — Alston & Bird LLP

(57) ABSTRACT

A method for improved traffic congestion estimation is provided using signal phase and timing data from traffic signals at intersections and probe data from vehicles traversing said intersections. An example method may include: identifying each of a plurality of paths through an intersection; identifying signal phase and timing data for each traffic light associated with each path through the intersection; receiving probe data for vehicles approaching or traversing the intersection; estimating a number of vehicles failing to traverse the intersection along a path through the intersection; estimating a congestion status of the path through the intersection based on the number of vehicles failing to traverse the intersection; and causing the congestion status to be provided to permit updating of a map to reflect the congestion status.

17 Claims, 11 Drawing Sheets

(56) References Cited

U.S. PATENT DOCUMENTS

2006/0155427 A1* 7/2006 Yang ..... G08G 1/07 701/1
2010/0145600 A1* 6/2010 Son ..... B60W 50/14 701/123
2011/0018701 A1* 1/2011 Mizuno ..... G08G 1/07 340/438
2011/0205086 A1* 8/2011 Lamprecht ..... G08G 1/08 340/928
2011/0224893 A1* 9/2011 Scofield ..... G01C 21/3492 701/119
2011/0260886 A1* 10/2011 Nagura ..... G08G 1/081 340/905
2011/0320111 A1* 12/2011 Sarma ..... G08G 1/0104 701/118
2012/0029730 A1* 2/2012 Nagura ..... F02N 11/0837 701/2
2012/0065871 A1* 3/2012 Deshpande ..... G08G 1/0112 701/118
2012/0249343 A1* 10/2012 Thomas ..... G08G 1/096716 340/905
2013/0006523 A1* 1/2013 Sato ..... G01C 21/3644 701/428
2013/0013178 A1* 1/2013 Brant ..... G08G 1/0116 701/117
2013/0041573 A1* 2/2013 Ochi ..... G01S 13/345 701/117
2013/0076538 A1* 3/2013 Uno ..... G08G 1/096716 340/905
2013/0110315 A1* 5/2013 Ogawa ..... G08G 1/096716 701/1
2013/0110316 A1* 5/2013 Ogawa ..... G08G 1/096716 701/1
2013/0110371 A1* 5/2013 Ogawa ..... G08G 1/095 701/70
2013/0222154 A1* 8/2013 Mori ..... G08G 1/09 340/905
2013/0245945 A1* 9/2013 Morita ..... G08G 1/096716 701/533
2014/0046509 A1* 2/2014 Otake ..... G08G 1/095 701/2
2014/0046581 A1 2/2014 Ota et al.
2014/0149029 A1* 5/2014 Sakakibara ..... G08G 1/0116 701/118
2014/0210645 A1* 7/2014 Sharma ..... G08G 1/052 340/907
2015/0141036 A1* 5/2015 Fix ..... H04W 64/00 455/456.1
2016/0076899 A1* 3/2016 MacNeille ..... G01C 21/3469 701/428
2016/0180710 A1* 6/2016 Maeda ..... G08G 1/096783 340/932
2016/0258777 A1* 9/2016 Bodake ..... G01C 21/367
2017/0192637 A1* 7/2017 Ren ..... G01C 21/3667
2017/0206783 A1* 7/2017 Miller ..... G08G 1/08
2017/0229015 A1* 8/2017 Shimamori ..... G08G 1/096791
2018/0045519 A1* 2/2018 Ghadiok ..... G01C 21/28

FOREIGN PATENT DOCUMENTS

CN 102436751 B * 9/2014
CN 105809958 A 7/2016
JP 2005339286 A * 12/2005
WO WO-2015/198156 A1 12/2015

OTHER PUBLICATIONS

Comert, Gurcan. "Simple analytical models for estimating the queue lengths from probe vehicles at traffic signals." Abstract only. Transportation Research Part B: Methodological, vol. 55, Sep. 2013. [Retrieved Aug. 29, 2016]. Retrieved from the Internet: <URL: http://www.sciencedirect.com/science/article/pii/S019126151300074X>. 3 pages.

Tange, Tomoyuki et al. "An Analysis Model of Queue Length Fluctuation at Signals Using Vehicle Trajectories." 2014 International Conference on Connected Vehicles and Expo (ICCVE), Nov. 3-7, 2014, 7 pages.

International Search Report and Written Opinion for International Application No. PCT/IB2017/057426, dated Mar. 16, 2018, 12 pages.

* cited by examiner

METHOD, APPARATUS AND COMPUTER PROGRAM PRODUCT FOR ESTIMATION OF ROAD TRAFFIC CONDITION USING TRAFFIC SIGNAL DATA

TECHNICAL FIELD

An example embodiments of the present invention relate generally to methods of determining traffic conditions on a roadway, and more particularly, to a method, apparatus, and computer program product for using vehicle probe data and traffic signal (signal phase and timing) data to improve traffic condition estimation.

BACKGROUND

The modern communications era has brought about a tremendous expansion of wireline and wireless networks. Computer networks, television networks, and telephone networks are experiencing an unprecedented technological expansion, fueled by consumer demand. Wireless and mobile networking technologies have addressed consumer demands while providing more flexibility and immediacy of information transfer.

The ubiquity of vehicle data that is available through mobile devices such as portable navigation systems and mobile devices enables crowd sourcing of vehicle data to better determine road conditions in a road network. The abundance of data can provide users with enhanced navigation systems that factor traffic conditions into route guidance suggestions. However, the volume of data can at times be misleading and can be misinterpreted, resulting in erroneous or confusing information.

BRIEF SUMMARY

In general, an example embodiment of the present invention provides an improved method of traffic congestion estimation using signal phase and timing data from traffic signals at intersections and probe data from vehicles traversing said intersections. According to an example embodiment, an apparatus may be provided including at least one processor and at least one memory including computer program code stored thereon. The at least one memory and the computer program code configured to, with the at least one processor, cause the apparatus to: identify each of a plurality of paths through an intersection; identify signal phase and timing data for each traffic light associated with each path through the intersection; receive probe data for vehicles approaching or traversing the intersection; estimate a number of vehicles failing to traverse the intersection along a path through the intersection; estimate a congestion status of the path through the intersection based on the number of vehicles failing to traverse the intersection; and cause the congestion status to be provided to permit updating of a map to reflect the congestion status.

According to some embodiments, causing the apparatus to estimate a number of vehicles failing to traverse the intersection may include causing the apparatus to: estimate a number of vehicles in a queue to traverse the intersection along the path through the intersection during a red phase of the traffic light controlling the path through the intersection; identify a green phase of the traffic light controlling the path through the intersection; and estimate the number of vehicles queued to traverse the intersection along the path through the intersection that failed to traverse the intersection during the green phase of the traffic light. Causing the apparatus to estimate a number of vehicles in a queue to traverse the intersection along the path through the intersection may include causing the apparatus to: map-match at least a portion of the probe data received for the path through the intersection; and estimate a number of vehicles in the queue to traverse the intersection along the path through the intersection during a red phase of the traffic light controlling the path through the intersection.

Causing the apparatus to estimate a congestion status of the intersection may include causing the apparatus to: identify a first threshold number of vehicles queued to traverse the intersection along the path through the intersection that fail to traverse the intersection along the path; identify a second threshold number of vehicles queued to traverse the intersection along the path through the intersection that fail to traverse the intersection along the path; estimate the congestion status of the path through the intersection to be relatively heavy in response to the number of vehicles failing to traverse the intersection along the path through the intersection being above the second threshold; estimate the congestion status of the path through the intersection to be medium in response to a number of vehicles failing to traverse the path through the intersection being above the first threshold, but below the second threshold; and estimate the congestion status of the path through the intersection to be relatively low in response to the number of vehicles failing to traverse the intersection along the path through the intersection being below the first threshold. Based on the congestion status, the apparatus may provide an indication on a display of a representation of the path through the intersection to be highlighted a first color in response to the congestion status being low, highlighted a second color in response to the congestion status being medium, and highlighted a third color in response to the congestion status being heavy.

According to some embodiments, the apparatus may optionally be caused to: calculate an intersection saturation vehicle number for the path through the intersection, where the intersection saturation vehicle number is calculated based on a number of vehicles failing to traverse the intersection along the path subtracted from the number of vehicles queued to traverse the intersection along the path; and estimate the number of vehicles at a start of a next transition from a red phase to a green phase of the traffic light controlling the path through the intersection. The apparatus may further be caused to determine a congestion condition in response to the estimated number of vehicles at the start of the next transition from a red phase to a green phase of the traffic light being greater than the intersection saturation vehicle number.

Certain embodiments of the present invention may provide a method including: identifying each of a plurality of paths through an intersection; identifying signal phase and timing data for each traffic light associated with each path through the intersection; receiving probe data for vehicles approaching or traversing the intersection; estimating a number of vehicles failing to traverse the intersection along a path through the intersection; estimating a congestion status of the path through the intersection based on the number of vehicles failing to traverse the intersection; and causing the congestion status to be provided to permit updating of a map to reflect the congestion status. Estimating a number of vehicles failing to traverse the intersection along the path may include: estimating a number of vehicles in a queue to traverse the intersection along the path through the intersection during a red phase of the traffic light controlling the path through the intersection; identifying a green phase of the traffic light controlling the path through the intersection; and estimating a number of vehicles of the vehicles queued to traverse the intersection along the path through the intersection but failed to traverse the intersection during the green phase of the traffic light.

Estimating a number of vehicles in a queue to traverse the intersection along the path through the intersection may include: map-matching at least a portion of the probe data received for the path through the intersection; and estimating a number of vehicles in the queue to traverse the intersection along the path through the intersection during a red phase of the traffic light controlling the path through the intersection. Estimating a congestion status of the intersection may include: identifying a first threshold number of vehicles queued to traverse the intersection along the path through the intersection that fail to traverse the intersection along the path; identifying a second threshold number of vehicles queued to traverse the intersection along the path through the intersection that fail to traverse the intersection along the path; estimating the congestion status of the path through the intersection to be relatively heavy in response to the number of vehicles failing to traverse the intersection along the path through the intersection being above the second threshold; estimating the congestion status of the path through the intersection to be medium in response to a number of vehicles failing to traverse the path through the intersection being above the first threshold but below the second threshold; and estimating the congestion status of the path through the intersection to be relatively low in response to the number of vehicles failing to traverse the intersection along the path through the intersection to be below the first threshold.

According to some embodiments, the method may provide an indication on a display of a representation of the path through the intersection to be highlighted in a first color in response to the congestion status being low, a second color in response to the congestion status being medium, and a third color in response to the congestion status being heavy. Methods may include: calculating an intersection saturation vehicle number for the path through the intersection, where the intersection saturation vehicle number is calculated based on a number of vehicles failing to traverse the intersection along the path subtracted from the number of vehicles queued to traverse the intersection along the path; and estimating the number of vehicles at a start of a next transition from a red phase to a green phase of the traffic light controlling the path through the intersection. Methods may optionally include determining a congestion condition in response to the estimated number of vehicles at the start of the next transition from a red phase to a green phase of the traffic light being greater than the intersection saturation number.

Another embodiment of the present invention may provide a computer program product including at least one non-transitory computer-readable storage medium having computer executable program code instructions stored therein. The computer-executable program code instructions may include: program code instructions to identify each of a plurality of paths through an intersection; program code instructions to identify signal phase and timing data for each traffic light associated with each path through the intersection; program code instructions to receive probe data for vehicles approaching or traversing the intersection; program code instructions to estimate a number of vehicles failing to traverse the intersection along a path through the intersection; program code instructions to estimate a congestion status of the path through the intersection based on the number of vehicles failing to traverse the intersection; and program code instructions to cause the congestion status to be provided to permit updating of a map to reflect the congestion status.

The program code instructions to estimate a number of vehicles failing to traverse the intersection along the path through the intersection may include: program code instructions to estimate a number of vehicles in a queue to traverse the intersection along the path through the intersection during a red phase of the traffic light controlling the path through the intersection; program code instructions to identify a green phase of the traffic light controlling the path through the intersection; and program code instructions to estimate a number of vehicles queued to traverse the intersection along the path through the intersection that failed to traverse the intersection during the green phase of the traffic light. The program code instructions to estimate a number of vehicles in a queue to traverse the intersection along the path through the intersection may include: program code instructions to map-match at least a portion of the probe data received for the path through the intersection; and program code instructions to estimate a number of vehicles in the queue to traverse the intersection along the path through the intersection during a red phase of the traffic light controlling the path through the intersection.

According to some embodiments, the program code instructions to estimate a congestion status of the intersection may include: program code instructions to identify a first threshold number of vehicles queued to traverse the intersection along the path through the intersection that fail to traverse the intersection along the path; program code instructions to identify a second threshold number of vehicles queued to traverse the intersection along the path through the intersection that fail to traverse the intersection along the path; program code instructions to estimate the congestion status of the path through the intersection to be relatively heavy in response to the number of vehicles failing to traverse the intersection along the path through the intersection being above the second threshold; program code instructions to estimate the congestion status to be medium in response to a number of vehicles failing to traverse the path through the intersection being above the first threshold but below the second threshold; and program code instructions to estimate the congestion status of the path through the intersection to be relatively low in response to the number of vehicles failing to traverse the intersection along the path through the intersection being below the first threshold.

According to some embodiments, the computer program product may include: program code instructions to provide an indication on a display of a representation of the path through the intersection to be highlighted in a first color in response to the congestion status being low, a second color in response to the congestion status being medium, and a third color in response to the congestion status being heavy. The computer program product may optionally include: program code instructions to calculate an intersection saturation vehicle number for the path through the intersection, where the intersection saturation vehicle number is calculated based on a number of vehicles failing to traverse the intersection along the path subtracted from the number of vehicles queued to traverse the intersection along the path; and program code instructions to estimate the number of vehicles at a start of a next transition from a red phase to a green phase of the traffic light controlling the path through the intersection.

BRIEF DESCRIPTION OF THE DRAWINGS

Figure 1:
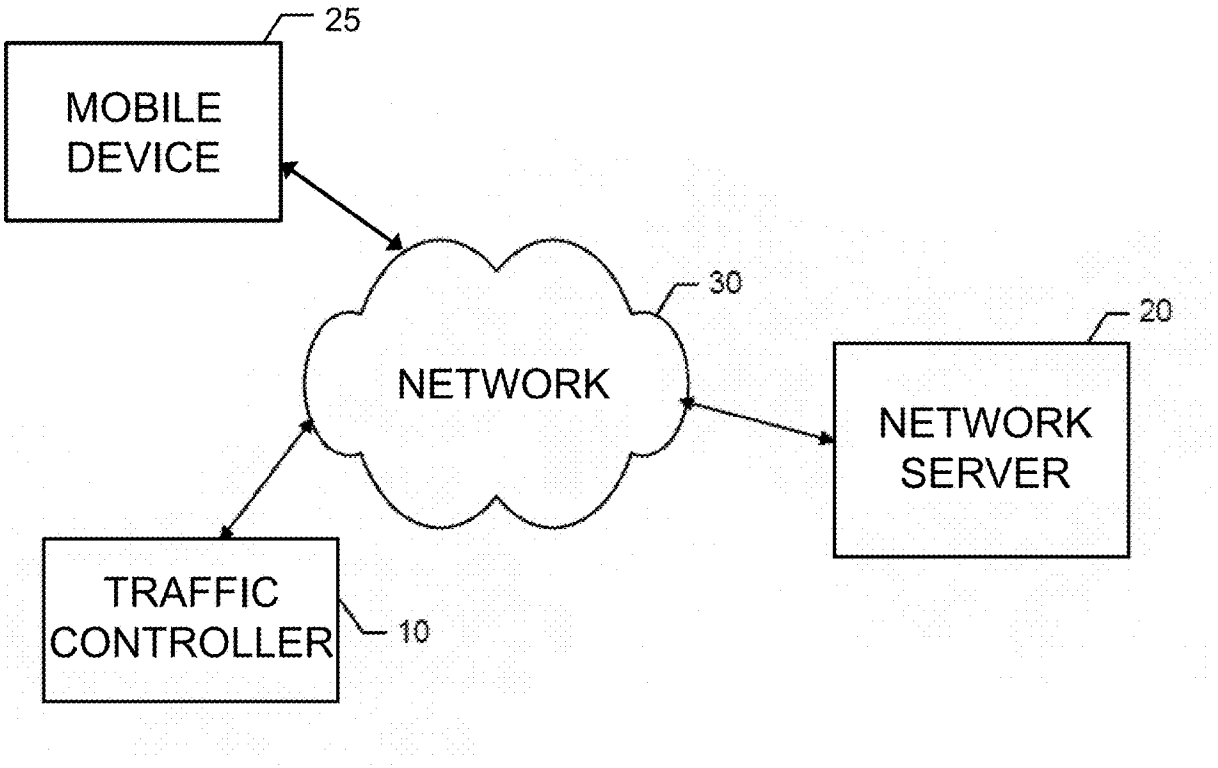
Figure 2:
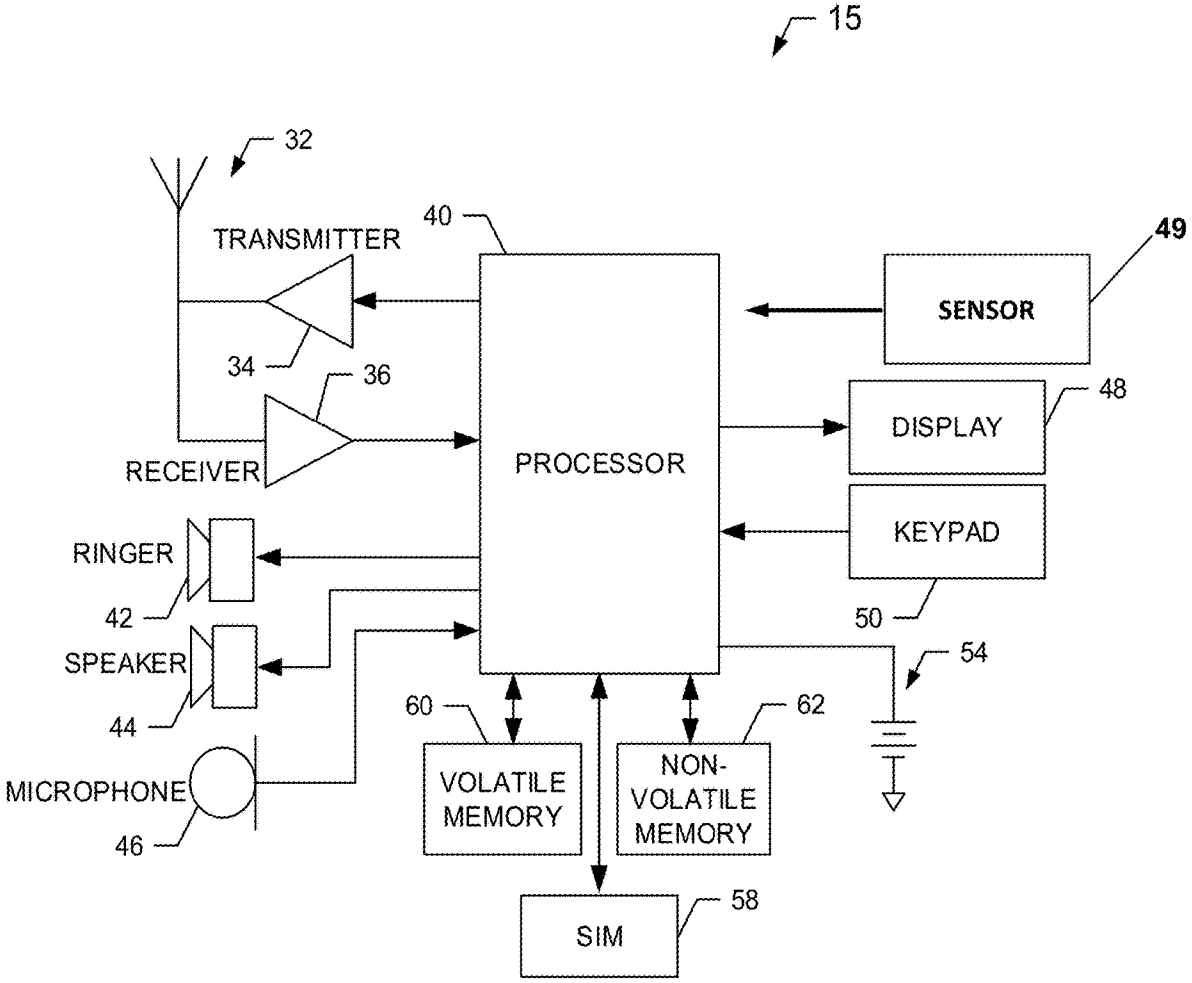
Figure 3:
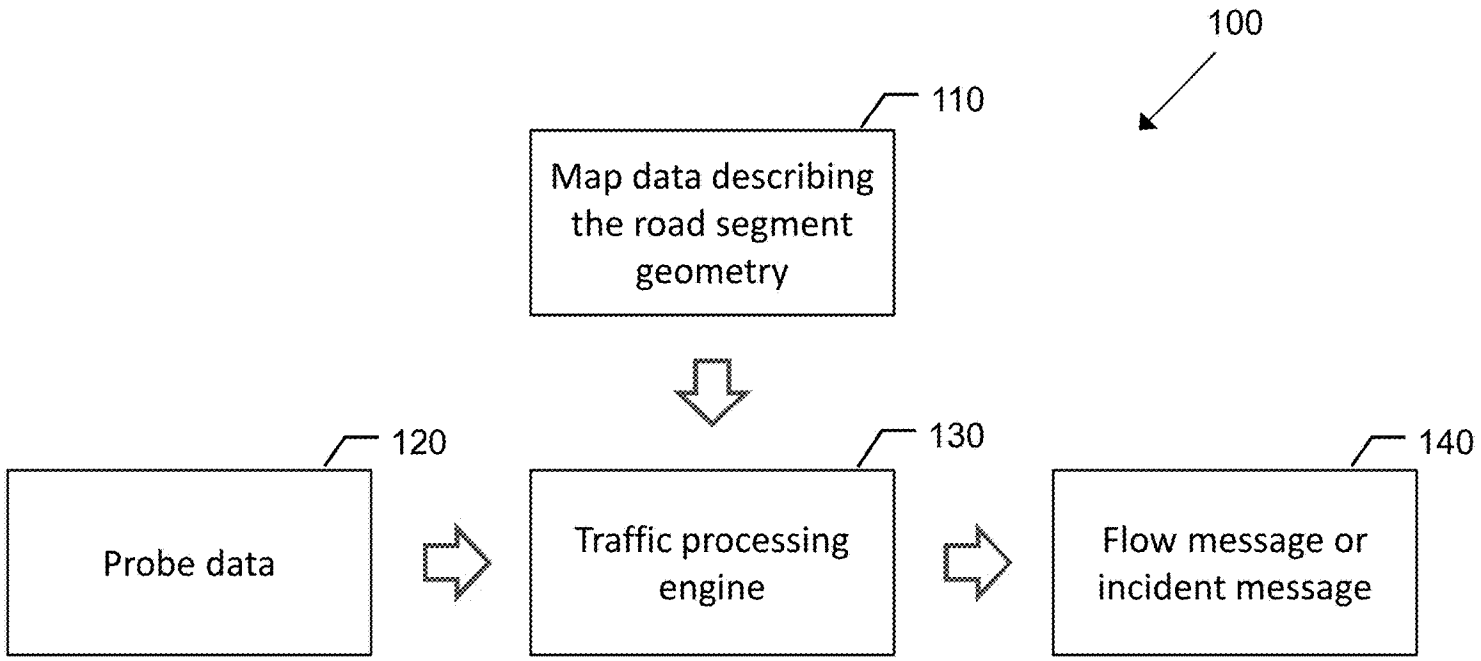
Figure 4:
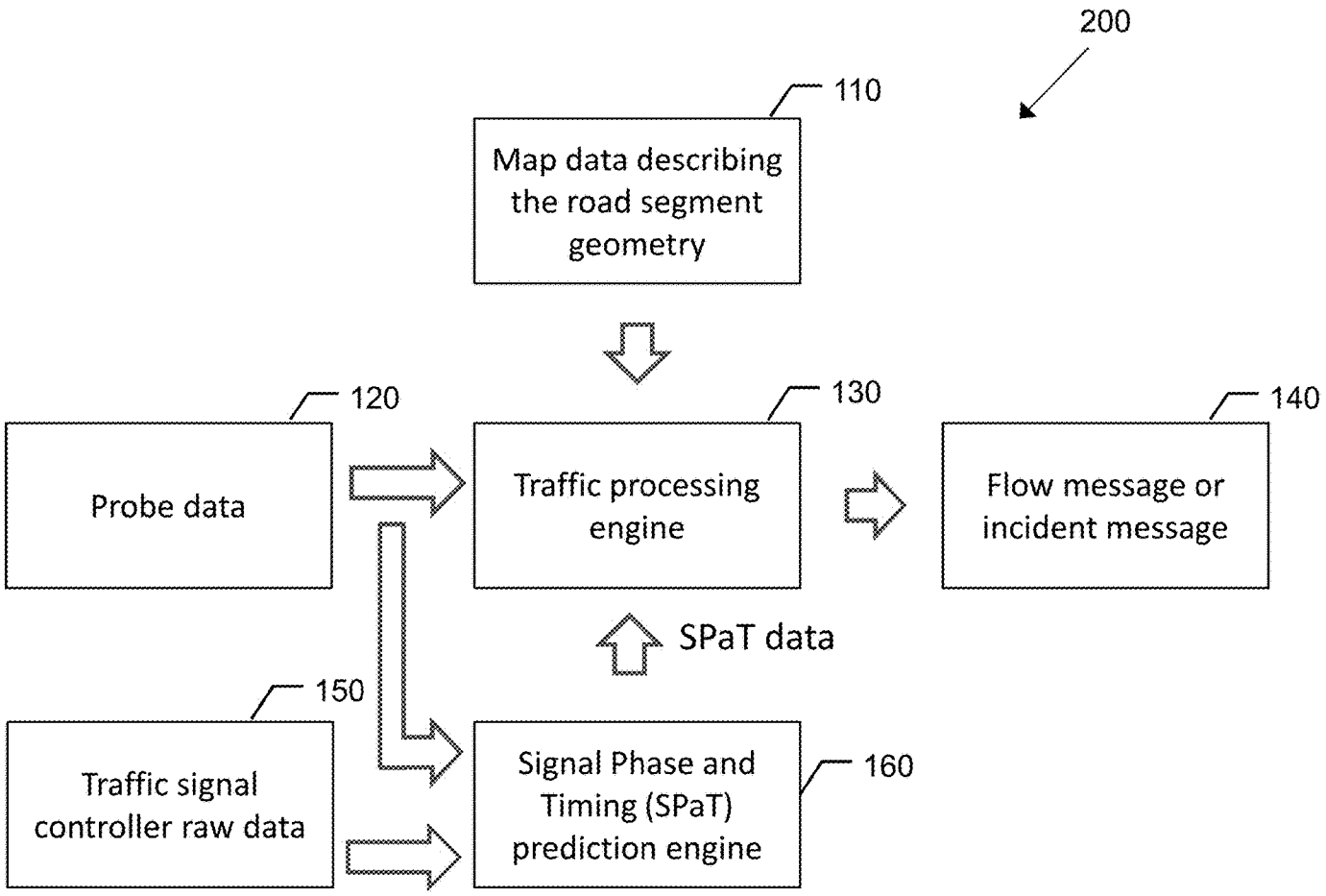
Figure 5:
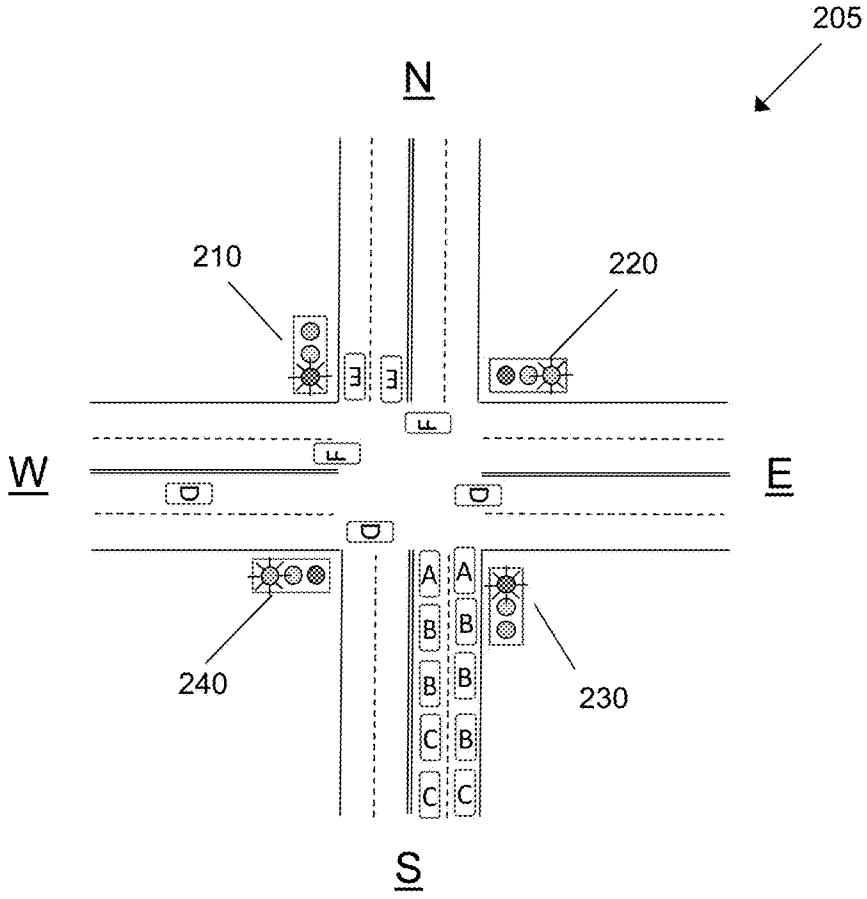
Figure 6:
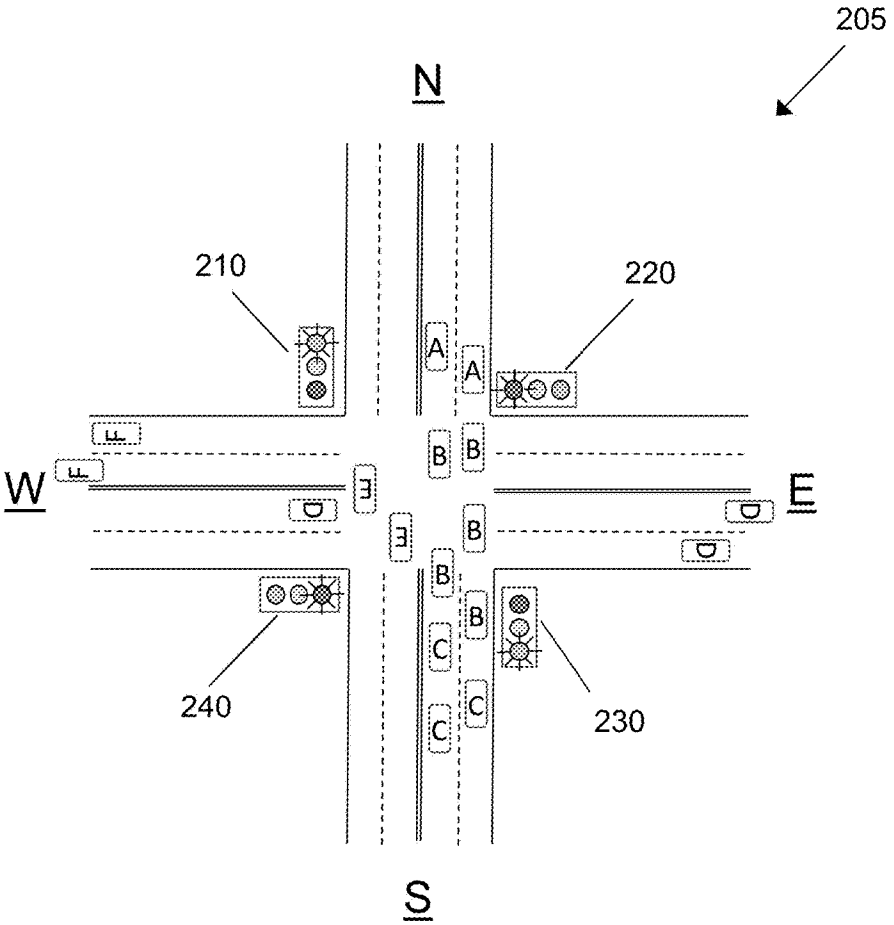
Figure 7:
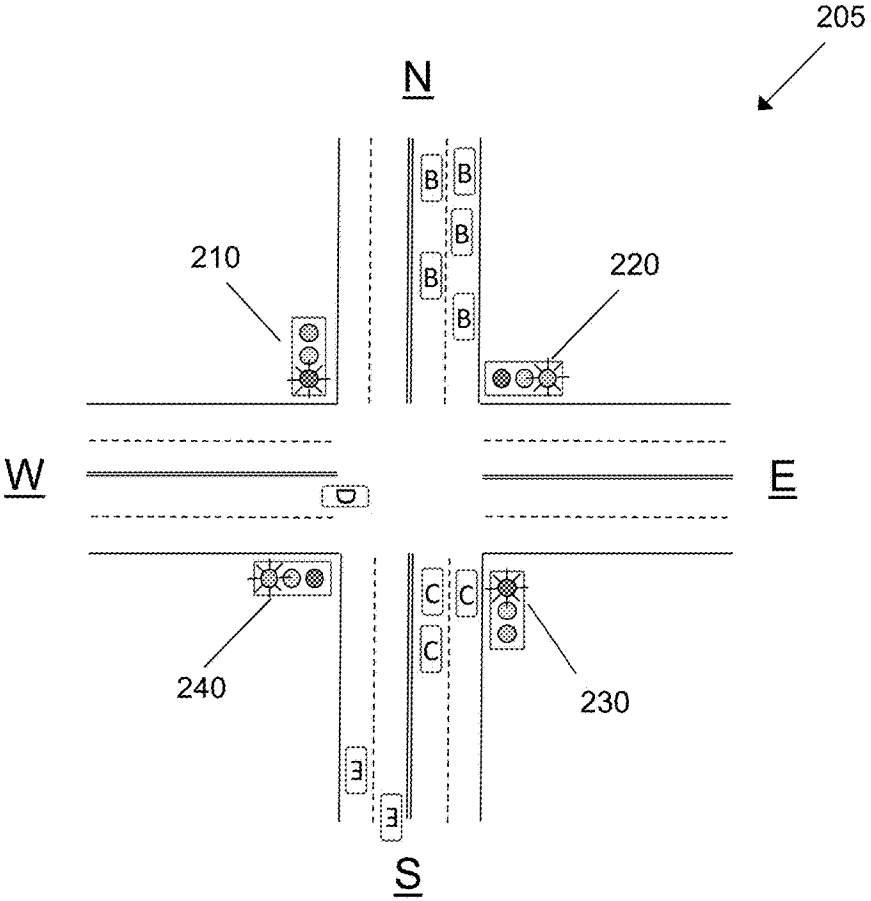
Figure 8:
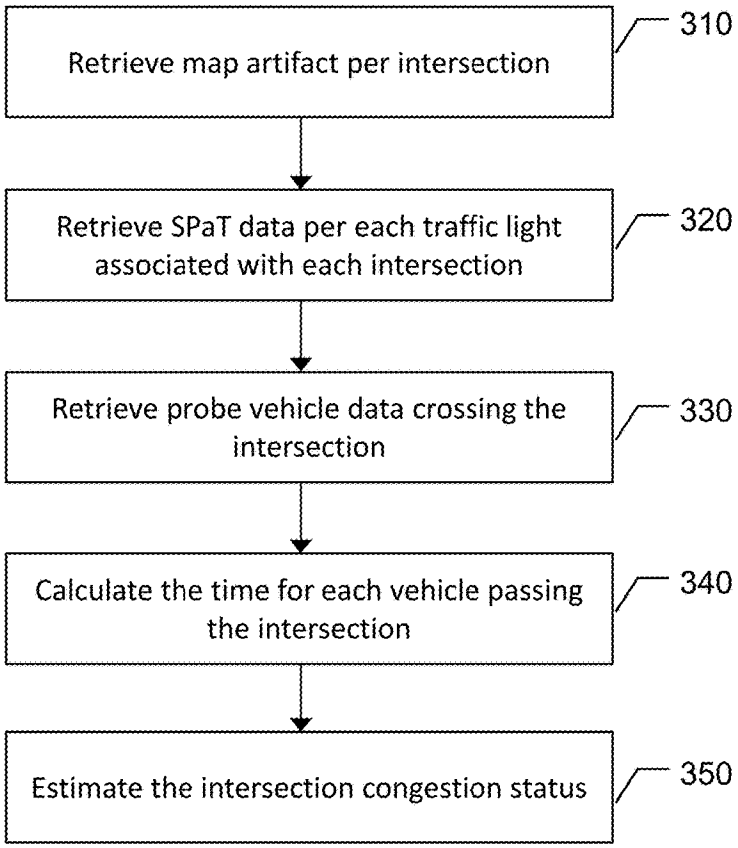
Figure 9:
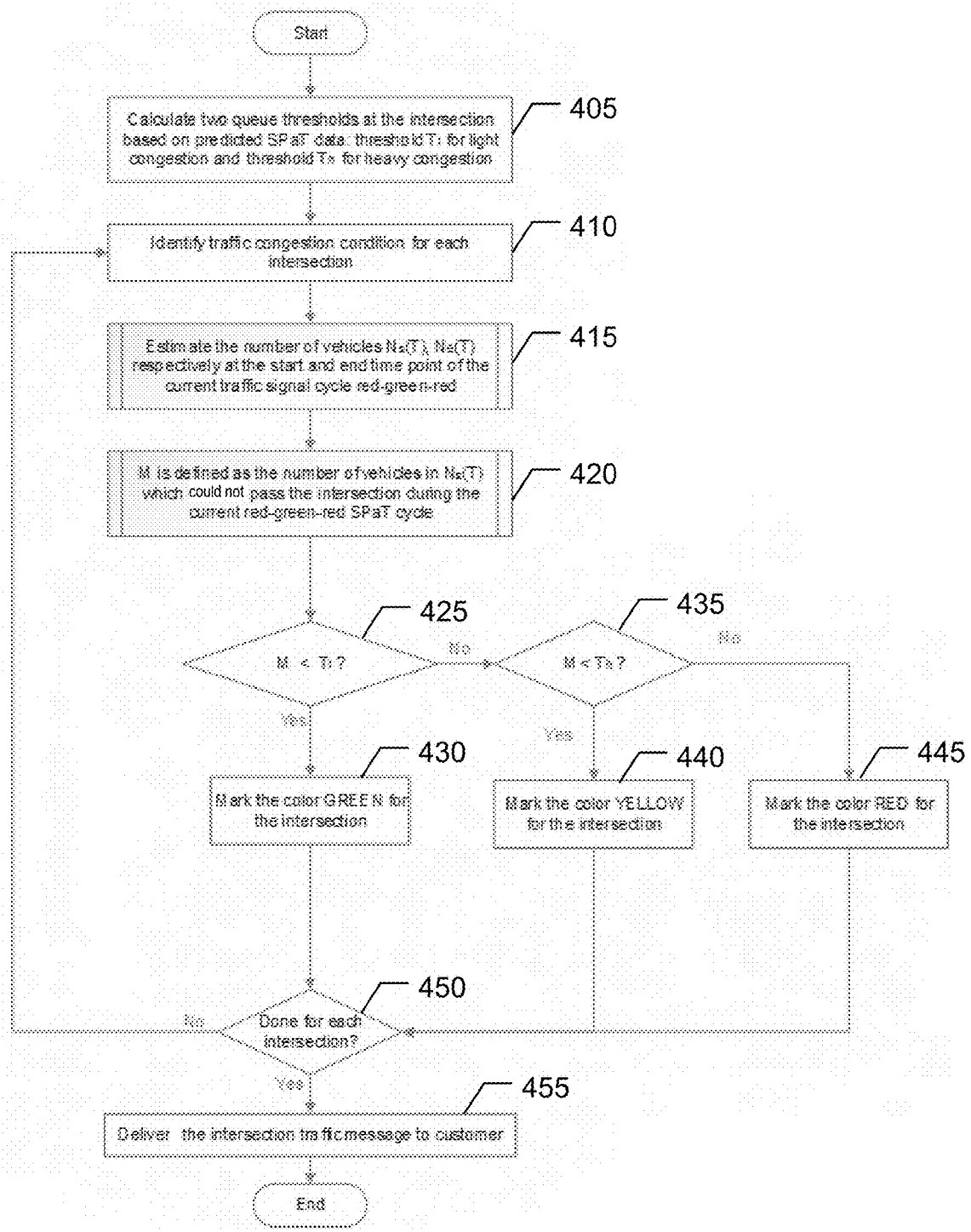
Figure 10:
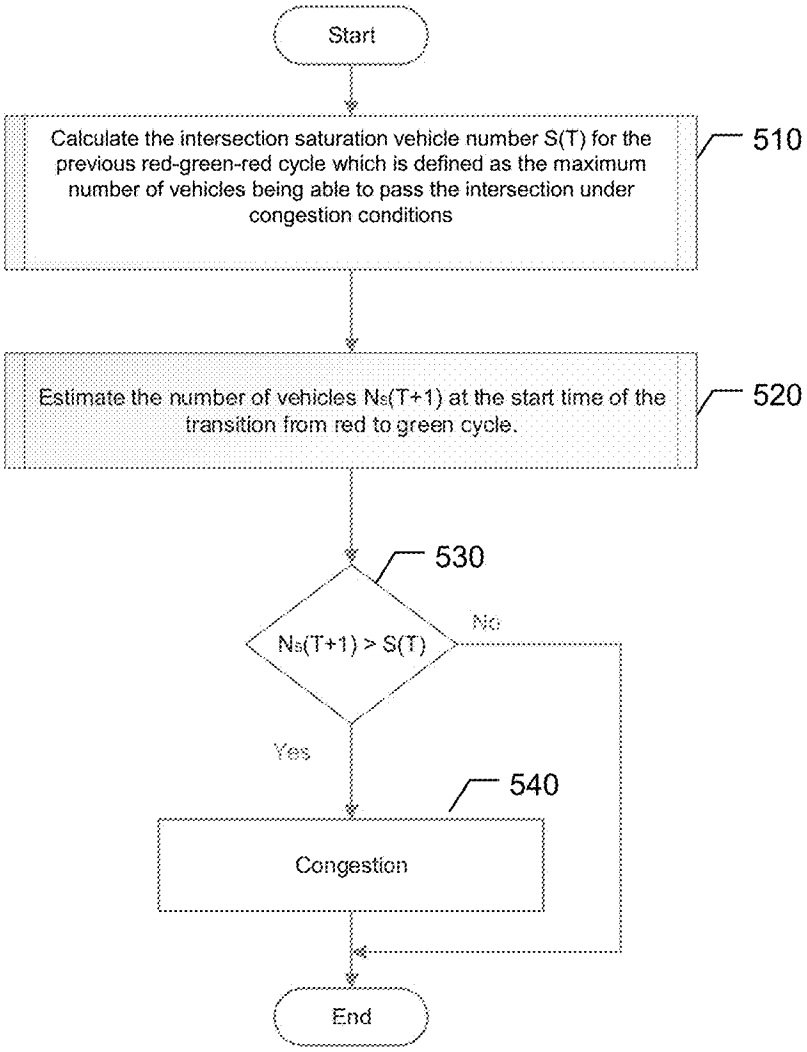
Figure 11:
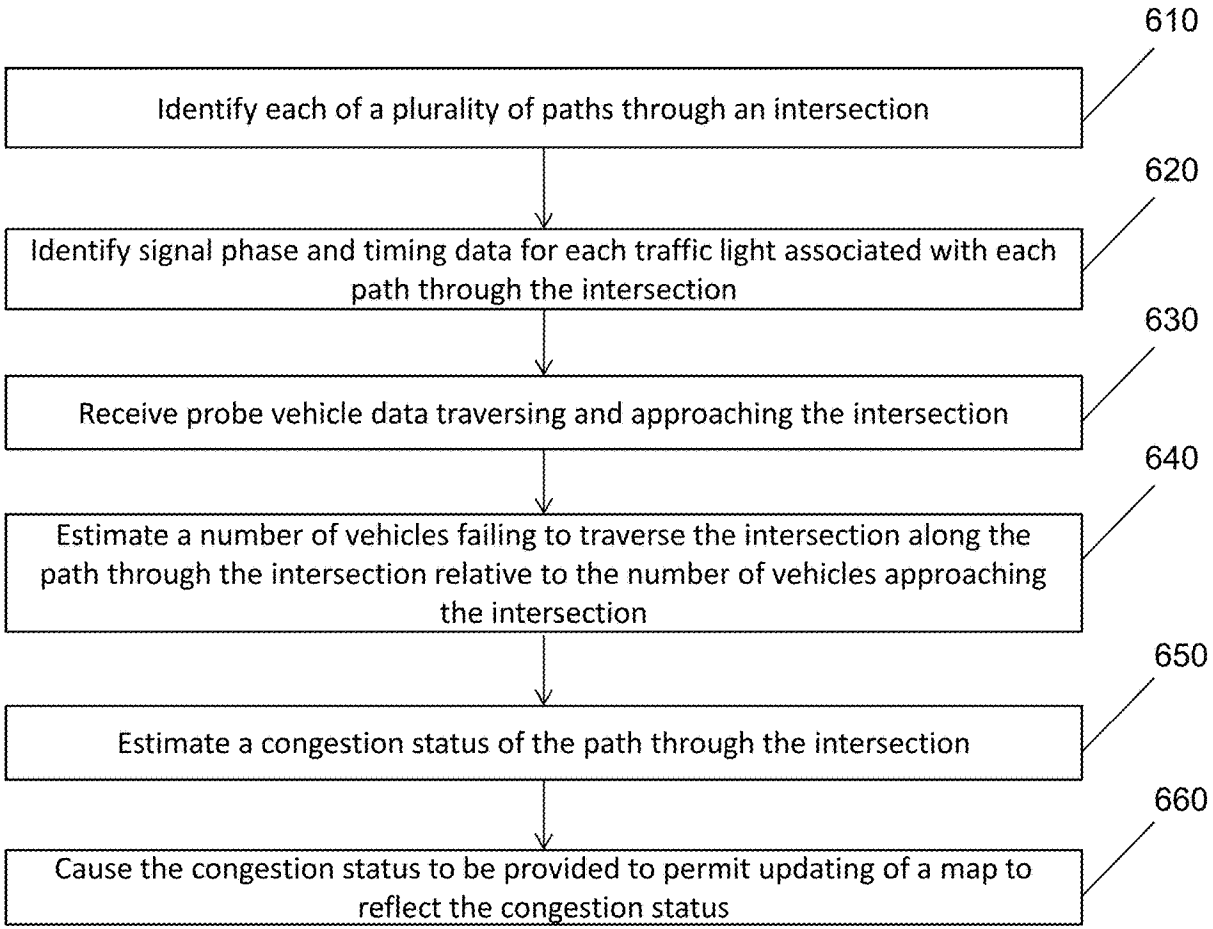

Having thus described certain example embodiments of the invention in general terms, reference will now be made to the accompanying drawings, which are not necessarily drawn to scale, and wherein:

FIG. 1 illustrates a communication system in accordance with an example embodiment of the present invention;

FIG. 2 is a schematic block diagram of a mobile device according to an example embodiment of the present invention;

FIG. 3 is a schematic block diagram of a system for providing traffic flow and congestion information to a user according to an example embodiment of the present invention;

FIG. 4 is another schematic block diagram of a system for providing traffic flow and congestion information to a user according to an example embodiment of the present invention;

FIG. 5 is a schematic diagram of an intersection including multiple pathways and vehicles traversing the intersection according to an example embodiment during a first signal phase;

FIG. 6 is a schematic diagram of an intersection including multiple pathways and vehicles traversing the intersection according to an example embodiment during a second signal phase;

FIG. 7 is a schematic diagram of an intersection including multiple pathways and vehicles traversing the intersection according to an example embodiment during a third signal phase;

FIG. 8 is a flowchart of a method for estimating the congestion status of an intersection according to an example embodiment of the present invention;

FIG. 9 is a flowchart illustrating a method of determining a level of congestion based on the number of vehicles passing and/or failing to pass through an intersection along a pathway through the intersection according to an example embodiment;

FIG. 10 is a flowchart of a method of predicting intersection congestion in the near future; and FIG. 11 is a flowchart of a method of estimating traffic congestion along a path through an intersection according to an example embodiment of the present invention.

DETAILED DESCRIPTION

Some example embodiments of the present invention will now be described more fully hereinafter with reference to the accompanying drawings, in which some, but not all embodiments of the invention are shown. Indeed, various embodiments of the invention may be embodied in many different forms and should not be construed as limited to the example embodiments set forth herein; rather, these example embodiments are provided so that this disclosure will satisfy applicable legal requirements. Like reference numerals refer to like elements throughout. As used herein, the terms "data," "content," "information" and similar terms may be used interchangeably to refer to data capable of being transmitted, received and/or stored in accordance with embodiments of the present invention.

An example embodiment of the present invention may be used in conjunction with, or implemented by, a plurality of components of a system for identifying traffic conditions based on vehicle probe data and signal phase and timing (SPaT) data from one or more traffic signals or traffic lights controlling traffic flows at one or more intersections. According to some embodiments as illustrated in FIG. 1, a system may include a traffic controller 10 which controls the traffic signals at an intersection, such as through the traffic light signal phase and timing, together with sequences and patterns of traffic light function. The traffic controller 10 may be located proximate the intersection of the traffic light, or the traffic controller may be located remotely from the controlled traffic light and in communication with the traffic light through various types of wired or wireless communications, as further described below. The system may further include a network server 20 that is in communication with the traffic controller, such as via network 30, to provide information and commands to the traffic controller, and/or to receive information and data from the traffic controller, such as traffic volumes, hardware issues, or various other information that may be useful in the control of a traffic system.

Traffic monitoring and control systems of various embodiments may further include a plurality of mobile devices 25 in communication with the network 30 to provide vehicle probe data from a plurality of vehicles proximate an area or region of interest. The mobile device 25 may be implemented by various embodiments of devices that are able to provide information associated with a vehicle, such as location information and other information which may include a time stamp, direction/trajectory, speed, or any other information which may be relevant to certain embodiments of the present invention.

Communication may be supported by network 30 as shown in FIG. 1 that may include a collection of a variety of different nodes, devices, or functions that may be in communication with each other via corresponding wired and/or wireless interfaces, or in ad-hoc networks such as those functioning over Bluetooth® communication. As such, FIG. 1 should be understood to be an example of a broad view of certain elements of a system that may incorporate example embodiments of the present invention and not an all inclusive or detailed view of the system or the network 30. Although not necessary, in some example embodiments, the network 30 may be capable of supporting communication in accordance with any one or more of a number of first-generation (1G), second-generation (2G), 2.5G, third-generation (3G), 3.5G, 3.9G, fourth-generation (4G) mobile communication protocols and/or the like.

One or more communication terminals, such as traffic controller 10 may be in communication with the network server 20 via the network 30, and each may include an antenna or antennas for transmitting signals to and for receiving signals from a base site, which could be, for example a base station that is part of one or more cellular or mobile networks or an access point that may be coupled to a data network; such as a local area network (LAN), a metropolitan area network (MAN), and/or a wide area network (WAN), such as the Internet. In turn, other devices (e.g., personal computers, server computers, or the like) may be coupled to the traffic controller 10, network server 20, or mobile device 25, via the network 30. By directly or indirectly connecting the mobile device 25, the traffic controller 10, the network server 20, and other devices to the network 30, the mobile device 25 and traffic controller 10 may be enabled to communicate with the other devices or each other, for example, according to numerous communication protocols including Hypertext Transfer Protocol (HTTP) and/or the like, to thereby carry out various communication or other functions of the traffic controller 10 and/or the mobile device 25.

Although the mobile device 25 may be configured in various manners, one example of a mobile device 25 embodied by a mobile terminal that could benefit from embodiments of the invention is depicted in the block diagram of FIG. 2. While several embodiments of the mobile device 25 may be illustrated and hereinafter described for purposes of example, other types of mobile terminals, such as portable digital assistants (PDAs), pagers, mobile televisions, gaming devices, all types of computers (e.g., laptops or mobile computers), cameras, audio/video players, radio, global positioning system (GPS) devices, or in vehicle configured sensors could be used for vehicle position location estimation purposes, or any combination of the aforementioned, and other types of communication devices, may employ an embodiment of the mobile device 25 of the present invention. Further, while the traffic controller 10 is generally described as a fixed computing device, an example embodiment may include a mobile terminal as illustrated in FIG. 2, or implement one or more features of the mobile terminal, such as the components to facilitate data collection and processing, and the components to facilitate communications, as will be appreciated by one of skills in the art.

The mobile device 25 or traffic controller 10 may, in some embodiments, be a computing device configured to employ an example embodiment of the present invention. However, in some embodiments, the device or controller, referred to collectively as a computing device, may be embodied as a chip or chipset. In other words, the computing device may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The computing device may therefore, in some cases, be configured to implement an embodiment of the present invention on a single chip or as a single "system on a chip." As such, in some cases, a chip or chipset may constitute means for performing one or more operations for providing the functionalities described herein.

FIG. 2 illustrates a computing device 15 which may embody the mobile device 25, the traffic controller 10, or the network server 20. The mobile device 25, traffic controller 10, and network server may omit certain features, or include additional features not illustrated as required to perform the various operations described below with respect to their functions. The illustrated computing device 15 may include an antenna 32 (or multiple antennas) in operable communication with a transmitter 34 and a receiver 36. The computing device may further include a processor 40 that provides signals to and receives signals from the transmitter and receiver, respectively. The signals may include signaling information in accordance with the air interface standard of the applicable cellular system, and/or may also include data corresponding to user speech, received data and/or user generated data. In this regard, the mobile terminal may be capable of operating with one or more air interface standards, communication protocols, modulation types, and access types. By way of illustration, the computing device 15 may be capable of operating in accordance with any of a number of first, second, third and/or fourth-generation communication protocols or the like. For example, the computing device 15 may be capable of operating in accordance with second-generation (2G) wireless communication protocols IS-136, GSM and IS-95, or with third-generation (3G) wireless communication protocols, such as UMTS, CDMA2000, wideband CDMA (WCDMA) and time division-synchronous CDMA (TD-SCDMA), with 3.9G wireless communication protocols such as E-UTRAN (evolved-UMTS terrestrial radio access network), with fourth-generation (4G) wireless communication protocols or the like.

The processor may be embodied in a number of different ways. For example, the processor may be embodied as various processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like), a hardware accelerator, and/or the like.

In an example embodiment, the processor 40 may be configured to execute instructions stored in the memory device 60 or otherwise accessible to the processor 40. Alternatively or additionally, the processor 40 may be configured to execute hard coded functionality. As such, whether configured by hardware or software methods, or by a combination thereof, the processor 40 may represent an entity (e.g., physically embodied in circuitry) capable of performing operations according to an embodiment of the present invention while configured accordingly. Thus, for example, when the processor 40 is embodied as an ASIC, FPGA or the like, the processor 40 may be specifically configured hardware for conducting the operations described herein. Alternatively, as another example, when the processor 40 is embodied as an executor of software instructions, the instructions may specifically configure the processor 40 to perform the algorithms and/or operations described herein when the instructions are executed. However, in some cases, the processor 40 may be a processor of a specific device (e.g., a mobile terminal or network device) adapted for employing an embodiment of the present invention by further configuration of the processor 40 by instructions for performing the algorithms and/or operations described herein. The processor 40 may include, among other things, a clock, an arithmetic logic unit (ALU) and logic gates configured to support operations of the processor 40.

The computing device 15 may also comprise a user interface including an output device such as an earphone or speaker 44, a ringer 42, a microphone 46, a display 48, and a user input interface, which may be coupled to the processor 40. The user input interface, which allows the computing device 15 to receive data, may include any of a number of devices allowing the computing device to receive data, such as a keypad 50, a touch sensitive display (not shown) or other input devices. In an embodiment including the keypad, the keypad may include numeric (0-9) and related keys (#, *), and other hard and/or soft keys used for operating the computing device 15. Alternatively, the keypad may include a conventional QWERTY keypad arrangement. The keypad may also include various soft keys with associated functions. In addition, or alternatively, the computing device 15 may include an interface device such as a joystick or other user input interface. The computing device 15 may further include a battery 54, such as a vibrating battery pack, for powering various circuits that are used to operate the computing device 15, as well as optionally providing mechanical vibration as a detectable output. The computing device 15 may also include a sensor 49, such as an accelerometer, motion sensor/detector, temperature sensor, or other environmental sensors to provide input to the processor indicative of a condition or stimulus of the computing device 15. According to some embodiments, the computing device 15 may include an image sensor as sensor 49, such as a camera configured to capture still and/or moving images.

The computing device 15 may further include a user identity module (UIM) 58, which may generically be referred to as a smart card. The UIM may be a memory device having a processor built in. The UIM may include, for example, a subscriber identity module (SIM), a universal integrated circuit card (UICC), a universal subscriber identity module (USIM), a removable user identity module (R-UIM), or any other smart card. The UIM may store information elements related to a mobile subscriber or to a service technician who is assigned the survey device 25, for example. In addition to the UIM, the mobile terminal may be equipped with memory. For example, the computing device 15 may include volatile memory 60, such as volatile Random Access Memory (RAM) including a cache area for the temporary storage of data. The computing device may also include other non-volatile memory 62, which may be embedded and/or may be removable. The non-volatile memory may additionally or alternatively comprise an electrically erasable programmable read only memory (EEPROM), flash memory or the like. The memories may store any of a number of pieces of information, and data, used by the computing device to implement the functions of the computing device. For example, the memories may include an identifier, such as an international mobile equipment identification (IMEI) code, capable of uniquely identifying the mobile terminal. Furthermore, the memories may store instructions for determining cell id information. Specifically, the memories may store an application program for execution by the processor 40, which determines an identity of the current cell, i.e., cell id identity or cell id information, with which the mobile terminal is in communication.

In general, an example embodiment of the present invention may provide a method for receiving probe data information from a plurality of probes, in-vehicle sensors, loop sensors, and traffic signal data related to signal phase and timing (SPaT), and using that information to determine traffic congestion information related to the intersection, while distinguishing between traffic congestion at the intersection and vehicles queued at the intersection resulting only from cycles of a traffic light.

Traffic signals, referred to herein generally as traffic lights, and traffic signal or traffic light controllers, referred to generally herein as traffic controllers, are becoming connected devices, as traffic controllers are more frequently networked with one another on a traffic control system that may be managed by a central traffic control operation. Managing traffic lights from a central traffic control operation may enable better control over traffic flow through an area, such as an urban or suburban region by having the traffic lights work in cooperation with one another. This cooperative operation may increase traffic throughput while reducing fuel consumption and reducing driver irritation. Further, increased traffic throughput may reduce the perceived need for higher-capacity roadways (e.g., through additional lanes or bypass roads) and may lead to cost savings through optimization of existing roadways. Central traffic control may also provide signal phase and timing data related to an intersection for each of a plurality of paths through the intersection.

The signal phase and timing of a traffic signal may be determined based on a central traffic controller, and may be broadcasting by a road side unit, such as computing device 15, that is located proximate the intersection. The signal phase may include the signal that is presented to a motorist, pedestrian, cyclist, etc., at an intersection. Traffic lights may include various phases. For example, a single-phase traffic light may include a flashing amber or red light indicating right-of-way at an intersection, or a green or red arrow to indicate a protected or prohibited turn. A dual-phase traffic light may include, for example, a pedestrian walk/don't walk signal. A three-phase traffic light may include a conventional green/amber/red traffic light. Certain embodiments described herein may pertain to all traffic light phases and is not limited to the brief description of phases above. The state transitions may include transitions between phases at a traffic light. A traffic light changing from green to amber is a first state transition, while changing from amber to red is a second state transition. The collected signal phase and timing of the state transitions may be provided through communication protocols through a distribution network shown in FIG. 1.

Various examples of the embodiments of this invention may relate in general to vehicular traffic pattern processing systems, a simplified example of which is shown in FIG. 3 as the system 100. In vehicular traffic system 100 there is a source of map data 110 that describes road segment geometry, a plurality of probes to supply probe data 120 (such as mobile device 25, embodied, for example, as computing device 15), and a traffic processing engine 130, which may be embodied, for example, by network server 20 of FIG. 1. The system of FIG. 3 may be used to integrate signal phase and timing data with vehicular traffic data from probes to deliver flow or incident messages as an output through traffic processing engine 130. The messages may be delivered to end customers (e.g., drivers, traffic control centers, emergency management personnel, etc.) via over the air radio interfaces, connected internet, or the like.

As illustrated in FIG. 3, inputs to the traffic processing engine may include real time probe data 130 received from mobile devices 25, and map artifact data which describes the road segment topology and geometry 110. The traffic processing engine receives the probe data, and may perform a map-matching process of the probe data to align the probe data with map data describing the road segment geometry. The output from the traffic processing engine may be an estimate of the current travel speed for a given road segment (e.g., road link). Based on this travel speed for a road segment, the road condition (e.g., road congestion) can be estimated to be free flow (e.g., no traffic congestion), queueing (e.g. traffic stopped due to traffic signals), or stationary (e.g., heavy traffic congestion), among other levels of congestion. From a user perception perspective, travel speed along a particular road segment that is equal to or lower than a queueing speed may be conventionally considered as road congestion which may be depicted graphically on a map interface as yellow or red to indicate the level of traffic slowing. However, traffic speed along a particular road segment may not always be indicative of a level of traffic congestion.

According to an example embodiment, road segments approaching intersections may have traffic traveling below the posted speed limits due to a red traffic signal, though this slowed traffic speed may not be indicative of congestion on the road segment, but instead due to the signal phase and timing of a traffic light of the intersection. When considering traffic control on arterial roads, intersections play a critical role in traffic flow management. An intersection having a traffic signal may provide movement control strategies to maximize vehicle capacity and safety on roads associated with the intersection. Each intersection may have its own assigned signal and phase timing, which may or may not be related to other intersections nearby to coordinate traffic flow. Traffic queueing due only to a traffic signal without substantial traffic volume or other factors slowing the traffic may be typical of an intersection, such that an indication that there is traffic congestion at the traffic signal is erroneous. Certain embodiments of the present invention clarify and distinguish traffic congestion from traffic queueing caused only by a traffic signal.

Traffic congestion may occur and begin to accumulate as a result of traffic volume exceeding available road capacity, particularly when an accident happens, times of peak volume (e.g., rush hour, sporting events, etc.), and during construction or maintenance of roadways. In general, traffic conditions may be provided by a navigation system service provider using probe data and sensor technologies. However, it may be difficult to distinguish between an intersection congestion traffic condition resulting from traffic congestion and traffic queueing/accumulating due to the signal phase and timing cycle phase of a traffic light. Certain embodiments described herein disclose an intelligent traffic process engine system capable of distinguishing between normal intersection traffic accumulation during yellow/red phases of a traffic light from road traffic congestion conditions. This differentiation may provide better and more accurate traffic services to an end user. This information may also be used as feedback for traffic signal controllers to better manage the signal phase and timing of an intersection during traffic congestion.

FIG. 4 illustrates an example embodiment of a traffic processing system 200 configured to distinguish between traffic congestion at an intersection and queued traffic at an intersection responsive to a yellow/red phase of the traffic light. The system 200 includes probe data 120 as an input that may be sourced from vehicles, service providers (e.g., navigation service providers), regulators (e.g., municipal traffic monitors), etc. Map data describing the road geometry 110 may also be provided by service providers or regulators, and the traffic processing engine 130 may map-match the probe data 120 to an associated road segment of the map data 110. Map-matching the probe data may include using statistical analysis of the probe positions along with consideration of locationing system (e.g. GPS) errors, poor location identification (e.g., in urban canyons or under heavy tree cover), or errors in digital map data geometry, to accurately map-match probe data points from vehicles with paths along existing roadways and paths through intersections. The traffic processing engine may use map-matching techniques matching the vehicle probe trajectories and location information with the road segments of a road network.

Traffic signal controller raw data 150 may be sourced from a municipality or regulator (e.g., traffic controller system) to convey the paths through an intersection and their respective phases (green, yellow, red). The probe data 120 and the traffic signal controller raw data 150 may be time synchronized through timestamps of the data or through synchronization points that align the data. This synchronization may be important to accurately reflect when traffic is stopped at an intersection and queueing due to a yellow/red light signal phase versus when traffic is stopped at an intersection during a green light signal phase as a result of traffic congestion. The traffic signal controller raw data may include traffic light sequences, durations of each phase of the signals during the sequences, changes in the sequence or durations due to time of day or volume of traffic detected, timestamps of one or more portions of a traffic signal sequence, or any other information relating to the traffic signals controlling an intersection and the respective paths there through.

The traffic signal controller raw data may be input to the signal phase and timing prediction engine 160 together with probe data 120. From this information, signal phase and timing data may be provided to the traffic processing engine, where a determination is made as to whether traffic at the intersection is a result of traffic signal phase (e.g., traffic queueing at a red light) or if traffic at the intersection is the result of traffic congestion. An output of this determination is provided as a message indicating whether traffic congestion is present at 140.

Capacity of a roadway is generally defined as the maximum rate at which vehicles can pass through a given point in a predetermined period of time under prevailing conditions. Saturation flow of a roadway or intersection occurs when the volume of traffic approaches the capacity, such as above 90% of capacity. At saturation or approaching saturation, vehicle travel time through an intersection may be presumed not to exceed a predefined value, such as 2.5 seconds, depending upon the size of the intersection and the posted speed limits of the path through the intersection. The capacity of an intersection may be established based on road width, number of lanes, function class of road, etc. Capacity for an intersection may be calculated by a traffic processing engine 130 or provided, for example, along with map data describing the road geometry 110. Optionally, traffic capacity for an intersection may be provided by a municipality or traffic controller along with traffic signal data 150. Capacity may be defined by vehicles per hour, vehicles per traffic light phase cycle, or vehicles per a specific period of time.

Alternatively, in the absence of traffic capacity information, traffic capacity may be calculated by traffic processing engine 130 based upon analysis of probe data 120 associated with vehicles traversing an intersection. Analysis of probe data may include analysis of probe data representing vehicles traversing an intersection along a path, and identifying the maximum number of vehicles passing through the intersection at or close to posted speed limits during a cycle of the traffic light or during a period of time, for example. The capacity of an intersection, and more specifically, a specific path through the intersection, may be used in distinguishing between traffic congestion and traffic queueing caused only by traffic light signal phase.

Based on an established capacity for a path through an intersection, whether received or calculated, a total number of vehicles that should traverse the intersection during a cycle of the signal phase may be established. If a predetermined number of vehicles queueing for the intersection during a yellow/red light phase of the traffic signal for a path through the intersection does not traverse the intersection during the subsequent green light phase of the traffic signal, mild traffic congestion may be established. The predetermined number of vehicles queueing for an intersection on a yellow/red light phase that do not traverse the intersection on the subsequent green light phase may be established based on the capacity of the path through the intersection. For example, if capacity for a path through an intersection is twenty vehicles per green light phase, and twenty five vehicles are queued at a yellow/red light phase of that path through the intersection, determining that five vehicles that were queued at the yellow/red light did not successfully traverse the intersection on the subsequent green may not be established as traffic congestion since the anticipated capacity for vehicles passing through the intersection along that path was met. The five vehicles that did not traverse the intersection on the green light phase may not be again queued due to congestion, but due to the traffic signal phase and timing.

For each path through an intersection, a first threshold may be established for vehicles that are queued at a traffic signal for that path at a yellow/red light phase that fail to traverse the intersection on the subsequent green light phase. According to an example embodiment, a first threshold may be ten vehicles. In this example, if thirty vehicles are queued at an intersection along a path through that intersection, and capacity for the intersection may be twenty vehicles per green light phase along that path. If only nine vehicles traverse the intersection during the green light phase, it is determined that eleven vehicles that could have traversed the intersection (based on capacity) fail to traverse the intersection along the path. As that number of vehicles is above the first threshold, light traffic congestion may be established.

A second threshold may be established for vehicles that are queued at a traffic signal for that path at a yellow/red light phase that fail to traverse the intersection on the subsequent green light phase. According to an example embodiment, the second threshold may be thirteen vehicles. If, based on capacity of the path through the intersection, more than thirteen vehicles fail to traverse the intersection during the green light phase that could have traversed the intersection along the path in free-flow traffic, heavy traffic congestion may be established for that path through the intersection.

In each case, above, the path through the intersection is experiencing a level of traffic congestion. This traffic congestion may be communicated to a user, such as a driver, a digital map user, or a traffic planner, in a number of different ways, such as by a navigation system. One way in which the level of traffic congestion may be communicated is by highlighting the path through the intersection a color associated with the level of vehicle congestion on a display configured to present a map interface. Highlighting the path through the intersection green may convey to a user that there is no traffic congestion at the path through the intersection. Highlighting the path through the intersection yellow may convey to a user that there is light or mild traffic congestion at the path through the intersection. Highlighting the path through the intersection red may convey that there is heavy traffic congestion at the path through the intersection.

FIGS. 5-7 illustrate an example embodiment of the present invention. According to FIG. 5, traffic through intersection 205 along the east-to-west path is in a green light phase 220, and vehicles "F" are traversing the intersection along that path. The west-to-east path is in a green light phase 240 and vehicles "D" are traversing the intersection without encumbrance. The north-to-south path is in a red phase 210 as is the south-to-north path at 230. Vehicles "E" are queueing in the north-to-south path, while vehicles "A", "B", and "C" are queueing in the south-to-north path. Upon the signals for the east-to-west 220 and west-to-east 240 switching to a yellow/red phase, traffic in those directions is stopped. The signals for the north-to-south 210 and south-to-north 230 enter a green phase whereby the "E" vehicles advance across the intersection as shown, and the "A", "B", and "C" vehicles begin to move. During the green light phase of 210 and 230, vehicles "E," "A," and "B" successfully traverse the intersection. However, vehicles "C" fail to traverse the intersection along the south-to-north path and stop at the yellow/red phase entered by signal 230 as shown in FIG. 7. If the capacity for the intersection on the south-to-north path was ten vehicles, and of the ten vehicles queueing at the light 230 in FIG. 5, only seven vehicles successfully traversed the intersection, three queueing vehicles are left that failed to traverse the intersection.

According to the example embodiment of FIGS. 5-7 described above, if a threshold for establishing medium traffic congestion is two vehicles queued along the south-to-north path of the intersection failing to traverse the intersection, medium traffic congestion may be established along the south-to-north path through the intersection 205. This may be communicated to a user, for example, by highlighting the south-to-north path through the intersection 205 in yellow in a digital map representation of a road network including the intersection 205.

FIGS. 8-11 are flowcharts illustrative of a system, method, and program product according to an example embodiment of the invention. The flowchart operations may be performed by a computing device, such as computing device 15 of FIG. 2, as operating over a communications network, such as that shown in FIG. 1. It will be understood that each block of the flowcharts and combinations of blocks in the flowcharts may be implemented by various means, such as hardware, firmware, processor, circuitry, and/or other device associated with execution of software including one or more computer program instructions. For example, one or more procedures described above may be embodied by computer program instructions. In this regard, the computer program instructions which embody the procedures described above may be stored by a memory device of an apparatus employing an embodiment of the present invention and executed by a processor in the apparatus. As will be appreciated, any such computer program instructions may be loaded onto a computer or other programmable apparatus (e.g., hardware), such as depicted in FIG. 2, to produce a machine, such that the resulting computer or other programmable apparatus embody means for implementing the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks.

Accordingly, blocks of the flowchart support combinations of means for performing the specified functions, combinations of operations for performing the specified functions and program instruction means for performing the specified functions. It will also be understood that one or more blocks of the flowchart, and combinations of blocks in the flowcharts, can be implemented by special purpose hardware-based computer systems which perform the specified functions, or combinations of special purpose hardware and computer instructions.

An example embodiment depicting an overview of methods described herein is illustrated in the flowchart of FIG. 8. As shown, a map artifact for each intersection is retrieved at 310. This map artifact may be digital map data as provided by a map data services provider, for example. The map artifact may include information regarding intersection capacity, posted speed limits, number of lanes, etc. At 320, signal phase and timing (SPaT) data for each traffic light of each intersection is retrieved. This SPaT data may include the various phases for each intersection and their timing schedule, along with any changes to that schedule based on time of day, for example. Probe data for vehicles crossing the intersection(s) may be retrieved at 330, while the time for each vehicle to traverse the intersection may be retrieved at 340. Vehicles traversing the intersection at or near posted speeds may be indicative of a lack of traffic congestion through the respective path of the intersection. Conversely, traffic slowly traversing the intersection, well slower than posted speeds, may be indicative of traffic congestion. While a vehicle traversing the intersection from a stop may take longer, generally, if a signal phase has been green for several seconds, traffic should be flowing through the intersection at close to posted speed limits during free flow traffic patterns.

FIG. 9 is a flowchart illustrating a method of determining a level of congestion based on the number of vehicles passing and/or failing to pass through an intersection along a pathway through the intersection according to an example embodiment. As shown, at 405 two queue thresholds for a path through the intersection are calculated based on predicted signal phase and timing data. A first threshold ($T_l$) is used for establishing light congestion, while a second threshold ($T_h$) is used for establishing heavy congestion. The thresholds may be calculated based on the capacity of the path through the intersection and the signal phase and timing information, such as the duration of each phase of the traffic signal for the path through the intersection. At 410, a traffic congestion condition for each path through the intersection is identified. An estimate is made of the number of vehicles along a path into the intersection at the time the signal turns from red to green ($N_s(T)$) at 415 using probe data points that are map-matched to the path. $N_s$ is the number of vehicles, while (T) represents the sampling time period of a red light phase to a green light phase to a red light phase of a traffic signal for a path through the intersection otherwise referred to as a "red-green-red cycle." An estimate is also made of the number of vehicles along the path entering the intersection at the time the light turns from green to red ($N_e(T)$), similarly using map-matched probe data. At 420, the number of vehicles along the path into the intersection (e.g., queueing) at the time the signal turning from red to green ($N_s(T)$) that fail to traverse the intersection is determined. This determination may be made based upon probe data information.

Once the number of vehicles that are queued to traverse the intersection along the path ($N_s(T)$) is known versus how many vehicles fail to traverse the intersection M from among those vehicles, ($N_s(T)$), a determination may be made with regard to the level of congestion. At 425, if the number of vehicles of queued for the intersection along the path ($N_s(T)$) that failed to traverse the intersection (M) is below the threshold for light congestion ($T_l$), it is established at 430 that there is no traffic congestion along the path entering the intersection, which may be communicated to a user by highlighting the pathway into the intersection in green. If the number of vehicles queued for the intersection along the path ($N_s(T)$) that failed to traverse the intersection (M) is above the threshold for light congestion ($T_l$), but below the threshold for heavy congestion ($T_h$) at 435, it is determined that the pathway into the intersection is of light congestion at 440. This may be communicated to a user, for example, by highlighting the pathway into the intersection in yellow on a digital map interface including a representation of the intersection. If the number of vehicles queued for the intersection along the path ($N_s(T)$) that failed to traverse the intersection (M) is above the threshold for heavy congestion ($T_h$), it is established that the pathway leading to the intersection has heavy congestion at 445. This may be communicated to a user, for example, by highlighting the pathway into the intersection in red on a digital map interface including a representation of the intersection.

This method may be performed for each intersection and each pathway into each intersection in a roadway network to establish traffic congestion patterns throughout the roadway network as shown at 450. Once the traffic congestion status for the pathways of the intersections are known, it may be communicated to users through a map interface or through other messaging methods at 455. The method of FIG. 9 may be performed periodically or on an ongoing basis, with updates to a digital map interface in real time as congestion is established on a per-intersection or per-path into intersection basis rather than upon congestion determination across the network or region of the network of roadways and intersections.

Further, while two thresholds are described and used in the method of FIG. 9, any number of thresholds may be used to provide more granular estimations of traffic congestion. Instead of red, yellow, and green, there may be shades of colors in between based on any number of thresholds, as would be appreciated by one of ordinary skill in the art. Alternatively, other types of visual demarcation may be employed including, for example, different types of shading, cross-hatching or the like.

While FIG. 9 illustrates a method for intersection congestion estimation based on currently received probe data, FIG. 10 illustrates a method of predicting intersection congestion in the near future. At 510, the intersection saturation vehicle number S(T) is calculated for a just-completed red-green-red phase cycle. The saturation vehicle number is the maximum number of vehicles being able to pass through the intersection along a path under congestion conditions. The intersection saturation number is determined on a per-path basis through an intersection, and can be estimated by subtracting the number of cars that fail to traverse the intersection along the path from the total number of vehicles queued for the path at the time the traffic signal turns green. This can be represented by: $S(T)=N_s(T)-M$. At 520, the number of vehicles at the start time of the transition from red to green of the traffic signal for the path is estimated $N_s(T+1)$. At 530, it is determined if the number of vehicles estimated at the start time of the transition from red to green of the traffic signal is greater than the intersection saturation vehicle number. Said differently, is $N_s(T+1)$ greater than S(T)? If no, then the estimation suggests that traffic is easing and congestion is not expected or anticipated. If $N_s(T+1)$ is greater than S(T), then there will be vehicles queued to traverse the intersection along the path that fail to do so, and congestion is anticipated at 540. Systems of certain embodiments may also establish whether traffic is improving or getting worse at a particular intersection. If a user is a distance away from an intersection, but traffic is determined to be improving at the intersection, a route through the intersection may still be preferable. If traffic is worsening at an intersection, a route through the intersection may be less desirable and a new route may be chosen. The trend of the traffic at the intersection may be established by comparing N(T) values at different points in time to determine whether traffic is improving or getting worse.

FIG. 11 illustrates a method of estimating traffic congestion along a path through an intersection according to an example embodiment of the present invention. As shown, a plurality of paths are identified through an intersection at 610, such as through map artifact data describing road segment geometry 110 of FIGS. 3 and 4. At 620, signal phase and timing data is identified for each traffic light associated with each path through the intersection. Probe data is received for vehicles approaching and/or traversing the intersection at 630. At 640, a number of vehicles failing to traverse the intersection is estimated relative to the number of vehicles approaching the intersection along the path or queued for the intersection along the path at the time when the traffic light turned from red to green. Based on the number of vehicles failing to traverse the intersection, a congestion status is estimated at 650. The congestion status is provided at 660 to permit the updating of a map to reflect the congestion status.

In an example embodiment, an apparatus for performing the method of FIGS. 8-11 above may comprise a processor (e.g., the processor 40) configured to perform some or each of the operations (310-350, 405-455, 510-540 and/or 610-660) described above. The processor may, for example, be configured to perform the operations (310-350, 405-455, 510-540 and/or 610-660) by performing hardware implemented logical functions, executing stored instructions, or executing algorithms for performing each of the operations. Alternatively, the apparatus may comprise means for performing each of the operations described above. In this regard, according to an example embodiment, examples of means for performing operations 310-350, 405-455, 510-540 and/or 610-660 may comprise, for example, the processor 40 and/or a device or circuit for executing instructions or executing an algorithm for processing information as described above.

As described above and as will be appreciated by one skilled in the art, embodiments of the present invention may be configured as a system, method or electronic device. Accordingly, embodiments of the present invention may be comprised of various means including entirely of hardware or any combination of software and hardware. Furthermore, embodiments of the present invention may take the form of a computer program product on a computer-readable storage medium having computer-readable program instructions (e.g., computer software) embodied in the storage medium. Any suitable non-transitory computer-readable storage medium may be utilized including hard disks, CD-ROMs, optical storage devices, or magnetic storage devices.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus comprising at least one processor and at least one memory including computer program code, the at least one memory and the computer program code configured to, with the at least one processor, cause the apparatus to at least perform:

identify each of a plurality of paths through an intersection;

identify signal phase and timing data for each traffic light associated with each path through the intersection;

receive probe data for vehicles approaching or traversing the intersection;

estimate a number of vehicles in a queue to traverse the intersection along a path of the plurality of paths through the intersection during a red phase of the traffic light controlling the path through the intersection;

identify a green phase of the traffic light controlling the path through the intersection immediately following the red phase of the traffic light controlling the path through the intersection;

estimate a number of vehicles of the vehicles queued to traverse the intersection along the path through the intersection during a next red phase of the traffic light, immediately following the green phase of the traffic light controlling the path through the intersection, that failed to traverse the intersection during the green phase of the traffic light;

estimate a congestion status of the path through the intersection based on the number of vehicles that failed to traverse the intersection during the green phase of the traffic light; and cause the congestion status to be provided to permit updating of a map to reflect the congestion status.

2. The apparatus of claim 1, wherein causing the apparatus to estimate a number of vehicles in a queue to traverse the intersection along the path through the intersection comprises causing the apparatus to:

map-match at least a portion of the probe data received for the path through the intersection; and estimate a number of vehicles in the queue to traverse the intersection along the path through the intersection during the red phase of the traffic light controlling the path through the intersection.

3. The apparatus of claim 2, wherein causing the apparatus to estimate a congestion status of the intersection comprises causing the apparatus to:

identify a first threshold number of vehicles queued to traverse the intersection along the path through the intersection that fail to traverse the intersection along the path during the green phase of the traffic light;

identify a second threshold number of vehicles queued to traverse the intersection along the path through the intersection that fail to traverse the intersection along the path during the green phase of the traffic light;

estimate the congestion status of the path through the intersection to be heavy in response to the number of vehicles failing to traverse the intersection along the path through the intersection being above the second threshold;

estimate the congestion status of the path through the intersection to be medium in response to a number of vehicles failing to traverse the path through the intersection being above the first threshold, but below the second threshold; and estimate the congestion status of the path through the intersection to be low in response to the number of vehicles failing to traverse the intersection along the path through the intersection being below the first threshold.

4. The apparatus of claim 3, wherein the apparatus is further caused to:

provide an indication on a display of a representation of the path through the intersection to be highlighted in a first color in response to the congestion status being low;

provide an indication on the display of a representation of the path through the intersection to be highlighted in a second color in response to the congestion status being medium; and provide an indication on the display of a representation of the path through the intersection to be highlighted in a third color in response to the congestion status being heavy.

5. The apparatus of claim 1, wherein the apparatus is further caused to:

calculate an intersection saturation vehicle number for the path through the intersection, wherein the intersection saturation vehicle number is calculated based on a number of vehicles failing to traverse the intersection along the path during a first transition from the green phase to the red phase of the traffic light subtracted from the number of vehicles queued to traverse the intersection along the path; and estimate the number of vehicles at a start of a next transition from a red phase to a green phase of the traffic light controlling the path through the intersection.

6. The apparatus of claim 5, wherein the apparatus is further caused to:

determine a congestion condition in response to the estimated number of vehicles at the start of the next transition from a red phase to a green phase of the traffic light being greater than the intersection saturation vehicle number.

7. A method comprising:

identifying each of a plurality of paths through an intersection;

identifying signal phase and timing data for each traffic light associated with each path through the intersection;

receiving probe data for vehicles approaching or traversing the intersection;

estimating a number of vehicles in a queue to traverse the intersection along a path of the plurality of paths through the intersection during a red phase of the traffic light controlling the path through the intersection;

identifying a green phase of the traffic light controlling the path through the intersection immediately following the red phase of the traffic light controlling the path through the intersection;

estimating a number of vehicles of the vehicles queued to traverse the intersection along the path through the intersection during a next red phase of the traffic light, immediately following the green phase of the traffic light controlling the path through the intersection, that failed to traverse the intersection during the green phase of the traffic light;

estimating a congestion status of the path through the intersection based on the number of vehicles that failed to traverse the intersection during the green phase of the traffic light; and causing the congestion status to be provided to permit updating of a map to reflect the congestion status.

8. The method of claim 7, wherein estimating a number of vehicles in a queue to traverse the intersection along the path through the intersection comprises:

map-matching at least a portion of the probe data received for the path through the intersection; and estimating a number of vehicles in the queue to traverse the intersection along the path through the intersection during the red phase of the traffic light controlling the path through the intersection.

9. The method of claim 8, wherein estimating a congestion status of the intersection comprises:

identifying a first threshold number of vehicles queued to traverse the intersection along the path through the intersection that fail to traverse the intersection along the path during the green phase of the traffic light;;

identifying a second threshold number of vehicles queued to traverse the intersection along the path through the intersection that fail to traverse the intersection along the path during the green phase of the traffic light;;

estimating the congestion status of the path through the intersection to be heavy in response to the number of vehicles failing to traverse the intersection along the path through the intersection being above the second threshold;

estimating the congestion status of the path through the intersection to be medium in response to a number of vehicles failing to traverse the path through the intersection being above the first threshold, but below the second threshold; and estimating the congestion status of the path through the intersection to be low in response to the number of vehicles failing to traverse the intersection along the path through the intersection being below the first threshold.

10. The method of claim 9, further comprising:

providing an indication on a display of a representation of the path through the intersection to be highlighted in a first color in response to the congestion status being low;

providing an indication on the display of a representation of the path through the intersection to be highlighted in a second color in response to the congestion status being medium; and providing an indication on the display of a representation of the path through the intersection to be highlighted in a third color in response to the congestion status being heavy.

11. The method of claim 7, further comprising:

calculating an intersection saturation vehicle number for the path through the intersection, wherein the intersection saturation vehicle number is calculated based on a number of vehicles failing to traverse the intersection along the path during a first transition from the green phase to the red phase of the traffic light subtracted from the number of vehicles queued to traverse the intersection along the path; and estimating the number of vehicles at a start of a next transition from a red phase to a green phase of the traffic light controlling the path through the intersection.

12. The method of claim 11, further comprising:

determining a congestion condition in response to the estimated number of vehicles at the start of the next transition from a red phase to a green phase of the traffic light being greater than the intersection saturation vehicle number.

13. A computer program product comprising at least one non-transitory computer-readable storage medium having computer-executable program code instructions stored therein, the computer-executable program code instructions comprising:

program code instructions to identify each of a plurality of paths through an intersection;

program code instructions to identify signal phase and timing data for each traffic light associated with each path through the intersection;

program code instructions to receive probe data for vehicles approaching or traversing the intersection;

program code instructions to estimate a number of vehicles in a queue to traverse the intersection along a path of the plurality of paths through the intersection during a red phase of the traffic light controlling the path through the intersection;

program code instructions to identify a green phase of the traffic light controlling the path through the intersection immediately following the red phase of the traffic light controlling the path through the intersection;

program code instructions to estimate a number of vehicles of the vehicles queued to traverse the intersection along the path through the intersection during a next red phase of the traffic light, immediately following the green phase of the traffic light controlling the path through the intersection, that failed to traverse the intersection during the green phase of the traffic light;

program code instructions to estimate a congestion status of the path through the intersection based on the number of vehicles that failed to traverse the intersection during the green phase of the traffic light; and program code instructions to cause the congestion status to be provided to permit updating of a map to reflect the congestion status.

14. The computer program product of claim 13, wherein the program code instructions to estimate a number of vehicles in a queue to traverse the intersection along the path through the intersection comprises:

program code instructions to map-match at least a portion of the probe data received for the path through the intersection; and program code instructions to estimate a number of vehicles in the queue to traverse the intersection along the path through the intersection during the red phase of the traffic light controlling the path through the intersection.

15. The computer program product of claim 14, wherein the program code instructions to estimate a congestion status of the intersection comprises:

program code instructions to identify a first threshold number of vehicles queued to traverse the intersection along the path through the intersection that fail to traverse the intersection along the path during the green phase of the traffic light;

program code instructions to identify a second threshold number of vehicles queued to traverse the intersection along the path through the intersection that fail to traverse the intersection along the path during the green phase of the traffic light;

program code instructions to estimate the congestion status of the path through the intersection to be heavy in response to the number of vehicles failing to traverse the intersection along the path through the intersection being above the second threshold;

program code instructions to estimate the congestion status of the path through the intersection to be medium in response to a number of vehicles failing to traverse the path through the intersection being above the first threshold, but below the second threshold; and program code instructions to estimate the congestion status of the path through the intersection to be low in response to the number of vehicles failing to traverse the intersection along the path through the intersection being below the first threshold.

16. The computer program product of claim 15, further comprising:

program code instructions to provide an indication on a display of a representation of the path through the intersection to be highlighted in a first color in response to the congestion status being low;

program code instructions to provide an indication on the display of a representation of the path through the intersection to be highlighted in a second color in response to the congestion status being medium; and program code instructions to provide an indication on the display of a representation of the path through the intersection to be highlighted in a third color in response to the congestion status being heavy.

17. The computer program code of claim 13, further comprising:

program code instructions to calculate an intersection saturation vehicle number for the path through the intersection, wherein the intersection saturation vehicle number is calculated based on a number of vehicles failing to traverse the intersection along the path during a first transition from the green phase to the red phase of the traffic light subtracted from the number of vehicles queued to traverse the intersection along the path; and program code instructions to estimate the number of vehicles at a start of a next transition from a red phase to a green phase of the traffic light controlling the path through the intersection.

* * * * *